US009099038B2

(12) United States Patent
Omoto

(10) Patent No.: US 9,099,038 B2
(45) Date of Patent: Aug. 4, 2015

(54) PIXEL CIRCUIT, DISPLAY PANEL, DISPLAY UNIT, AND ELECTRONIC SYSTEM

(75) Inventor: Keisuke Omoto, Kanagawa (JP)

(73) Assignee: JOLED INC. (JP)

( * ) Notice: Subject to any disclaimer, the term of this patent is extended or adjusted under 35 U.S.C. 154(b) by 287 days.

(21) Appl. No.: 13/599,109

(22) Filed: Aug. 30, 2012

(65) Prior Publication Data

US 2013/0057457 A1 Mar. 7, 2013

(30) Foreign Application Priority Data

Sep. 7, 2011 (JP) ..... 2011-194812

(51) Int. Cl.
*G09G 3/30* (2006.01)
*G09G 3/32* (2006.01)

(52) U.S. Cl.
CPC ..... *G09G 3/3233* (2013.01); *G09G 2300/0452* (2013.01); *G09G 2300/0852* (2013.01); *G09G 2320/045* (2013.01)

(58) Field of Classification Search
CPC ..... G09G 3/30
See application file for complete search history.

(56) References Cited

U.S. PATENT DOCUMENTS

| | | | | |
|---|---|---|---|---|
| 7,557,783 | B2 * | 7/2009 | Kim | 345/82 |
| 8,614,652 | B2 * | 12/2013 | Nathan et al. | 345/55 |
| 2005/0040441 | A1 * | 2/2005 | Kimura | 257/249 |
| 2011/0032232 | A1 * | 2/2011 | Smith | 345/211 |

FOREIGN PATENT DOCUMENTS

JP 2008-083272 4/2008

* cited by examiner

*Primary Examiner* — Gregory J Tryder
*Assistant Examiner* — Richard Hong
(74) *Attorney, Agent, or Firm* — Sheridan Ross P.C.

(57) ABSTRACT

A pixel circuit includes: a writing circuit that samples a voltage of a signal line; and a driving circuit that generates from the signal line a current that depends on an output of the writing circuit, and delivers the current to a light-emitting device of a current-drive type.

17 Claims, 10 Drawing Sheets

$$Vg1=Vd+\frac{CsubCs+ColedCsub}{CsubCs+CsColed+ColedCsub}(Vdd-Vd)$$

$$Vs1=Vd-Vth+\frac{CsubCs}{CsubCs+CsColed+ColedCsub}(Vdd-Vd)$$

$$Vgs1=Vth+\frac{ColedCsub}{CsubCs+CsColed+ColedCsub}(Vdd-Vd)$$

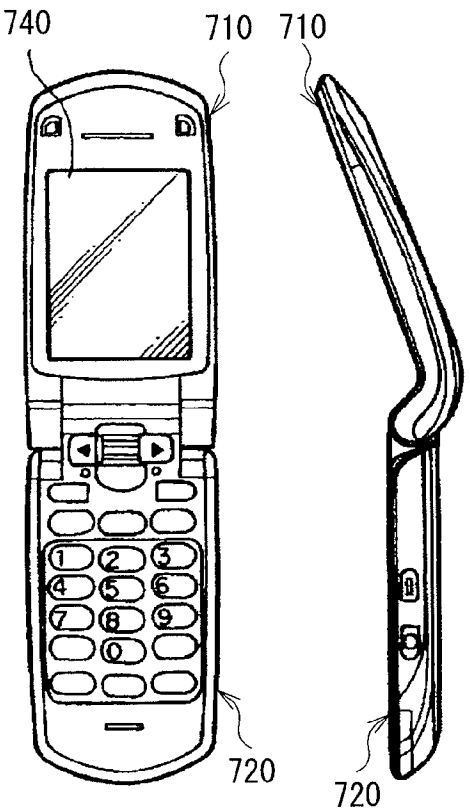
FIG. 11A
FIG. 11B
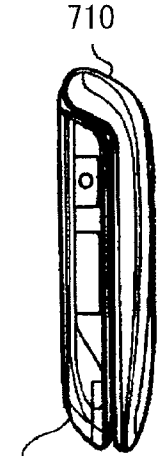
FIG. 11D
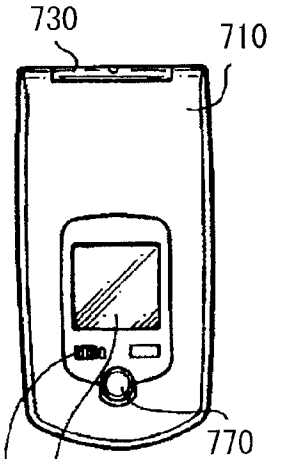
FIG. 11C
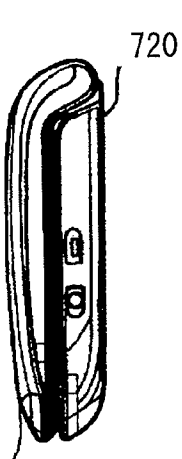
FIG. 11E
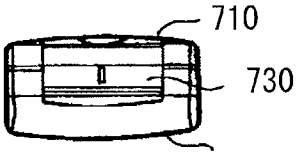
FIG. 11F
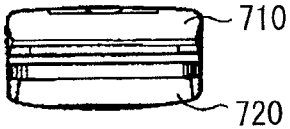
FIG. 11G

PIXEL CIRCUIT, DISPLAY PANEL, DISPLAY UNIT, AND ELECTRONIC SYSTEM

BACKGROUND

The present disclosure is related to a pixel circuit that drives a self-emitting device such as an organic EL (ElectroLuminescence) device for example. Further, the present disclosure is related to a display panel, a display unit, and an electronic system that include the above-described pixel circuit.

In recent years, in the field of a display unit for performing an image display, a display unit using a current drive type optical device the luminescence of which varies depending on a value of a flowing current, such as an organic EL device as a pixel light-emitting device has been developed and the commercialization thereof has been advanced (for example, see Japanese Unexamined Patent Application Publication No. 2008-083272). Unlike a liquid crystal device and the like, an organic EL device is a self-emitting device. Therefore, a display unit using an organic EL device (organic EL display unit) eliminates the need for a light source (backlight), achieving higher image visibility, lower power consumption, and higher device response speed as compared with a liquid crystal display unit involving a light source.

As with a liquid crystal display unit, an organic EL display unit has a simple (passive) matrix method and an active matrix method as a drive method thereof. The former is disadvantageous in that it is difficult to achieve a large-sized and high-definition display unit in spite of a simple structure. Consequently, at present, the active matrix method has been actively developed. This method controls a current flowing through a light-emitting device arranged for each pixel using an active circuit provided for each light-emitting device.

SUMMARY

In a display unit that employs the active matrix method, each pixel circuit is typically connected with a signal line extending in a column direction, as well as a scanning line and a power supply line that extend in a row direction. As a result, it is likely that these wire lines pose an obstacle to the future achievement of higher definition.

It is desirable to provide a pixel circuit with less wiring connections in number than before. It is also desirable to provide a display panel, a display unit, and an electronic system that include the above-described pixel circuit.

A pixel circuit according to an embodiment of the present disclosure includes: a writing circuit sampling a voltage of a signal line; and a driving circuit generating from the signal line a current that depends on an output of the writing circuit, and delivering the current to a light-emitting device of a current-drive type.

A display panel according to an embodiment of the present disclosure includes: a light-emitting device of a current-drive type provided for each pixel; and a pixel circuit provided for each of the pixels and driving the corresponding light-emitting device. Each of the pixel circuits includes a writing circuit sampling a voltage of a signal line, and a driving circuit generating from the signal line a current that depends on an output of the writing circuit, and delivering the current to the light-emitting device.

A display unit according to an embodiment of the present disclosure includes: a display panel including a light-emitting device of a current-drive type and a pixel circuit, in which the light-emitting device is provided for each pixel, and the pixel circuit is provided for each of the pixels and drives the corresponding light-emitting device; and a peripheral circuit driving the pixel circuits. Each of the pixel circuits includes a writing circuit sampling a voltage of a signal line, and a driving circuit generating from the signal line a current that depends on an output of the writing circuit, and delivering the current to the light-emitting device.

An electronic system according to an embodiment of the present disclosure includes: a display unit including a display panel and a peripheral circuit, in which the display panel includes a light-emitting device of a current-drive type and a pixel circuit. The light-emitting device is provided for each pixel, the pixel circuit is provided for each of the pixels and drives the corresponding light-emitting device, and the peripheral circuit drives the pixel circuits. Each of the pixel circuits includes a writing circuit sampling a voltage of a signal line, and a driving circuit generating from the signal line a current that depends on an output of the writing circuit, and delivering the current to the light-emitting device.

In the pixel circuit, the display panel, the display unit, and the electronic system according to the above-described respective embodiments of the present disclosure, the current that depends on the output of the writing circuit is generated from the signal line, and the generated current is delivered to the current-drive type light-emitting device. Consequently, the current that depends on the output of the writing circuit flows through the light-emitting device without the necessity of providing separately from the signal line a wiring for supplying a current to the driving circuit.

In the pixel circuit, the display panel, the display unit, and the electronic system according to the above-described respective embodiments of the present disclosure, the current that depends on the output of the writing circuit is delivered to the light-emitting device, without providing a wiring for providing a current to the driving circuit separately from the signal line. Hence, it is possible to reduce the number of wiring connections as compared with an existing technology.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the present disclosure, and are incorporated in and constitute a part of this specification. The drawings illustrate embodiments and, together with the specification, serve to explain the principles of the present technology.

FIG. 8A is a perspective view showing an external appearance of an application example 2 that is viewed from the front side thereof, while

FIG. 11A is a front view of an application example 5 in an open state, FIG. 11B is a side view thereof, FIG. 11C is a front view in a closed state, FIG. 11D is a left-side view, FIG. 11E is a right-side view, FIG. 11F is a top view, and FIG. 11G is a bottom view.

DETAILED DESCRIPTION

Hereinafter, some embodiments of the present disclosure are described in details with reference to the drawings. It is to be noted that the descriptions are provided in the order given below.

1. Embodiment of the Present Disclosure (Display Unit)

Example where a drain of a driving transistor is connected with a signal line.

2. Application Examples (Electronic System)

Example where a display unit according to the above-described embodiment of the present disclosure is applied to an electronic system.

1. EMBODIMENT OF THE PRESENT DISCLOSURE

[Configuration]

Figure 1:
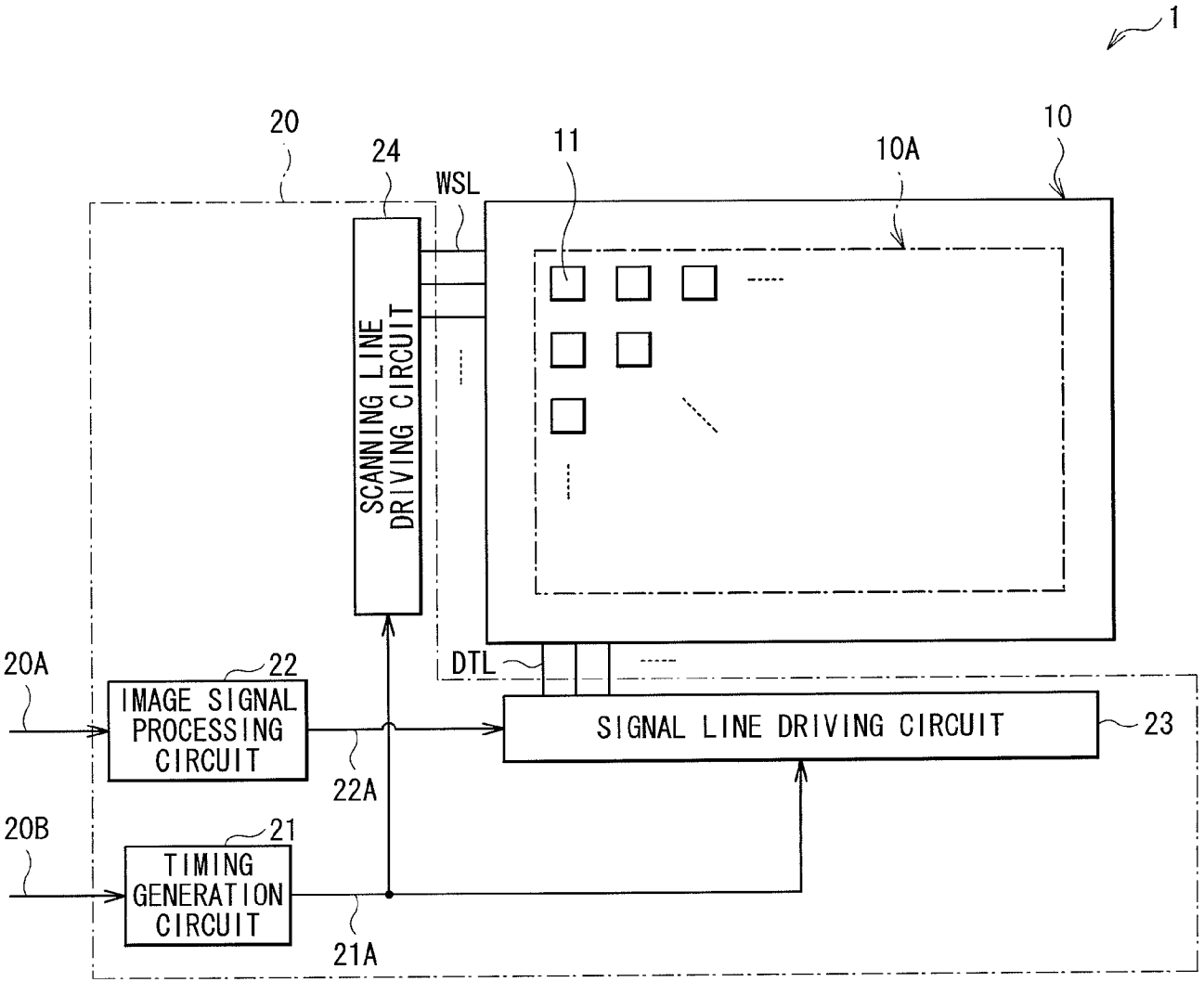
FIG. 1 is a schematic block diagram of a display unit according to an embodiment of the present disclosure.

FIG. 1 shows a schematic configuration of a display unit 1 according to an embodiment of the present disclosure. The display unit 1 includes a display panel 10 and a peripheral circuit 20 to drive the display panel 10. The peripheral circuit 20 has, for example, a timing generation circuit 21, an image signal processing circuit 22, a signal line driving circuit 23, and a scanning line driving circuit 24.

(Display Panel 10)

Figure 2:
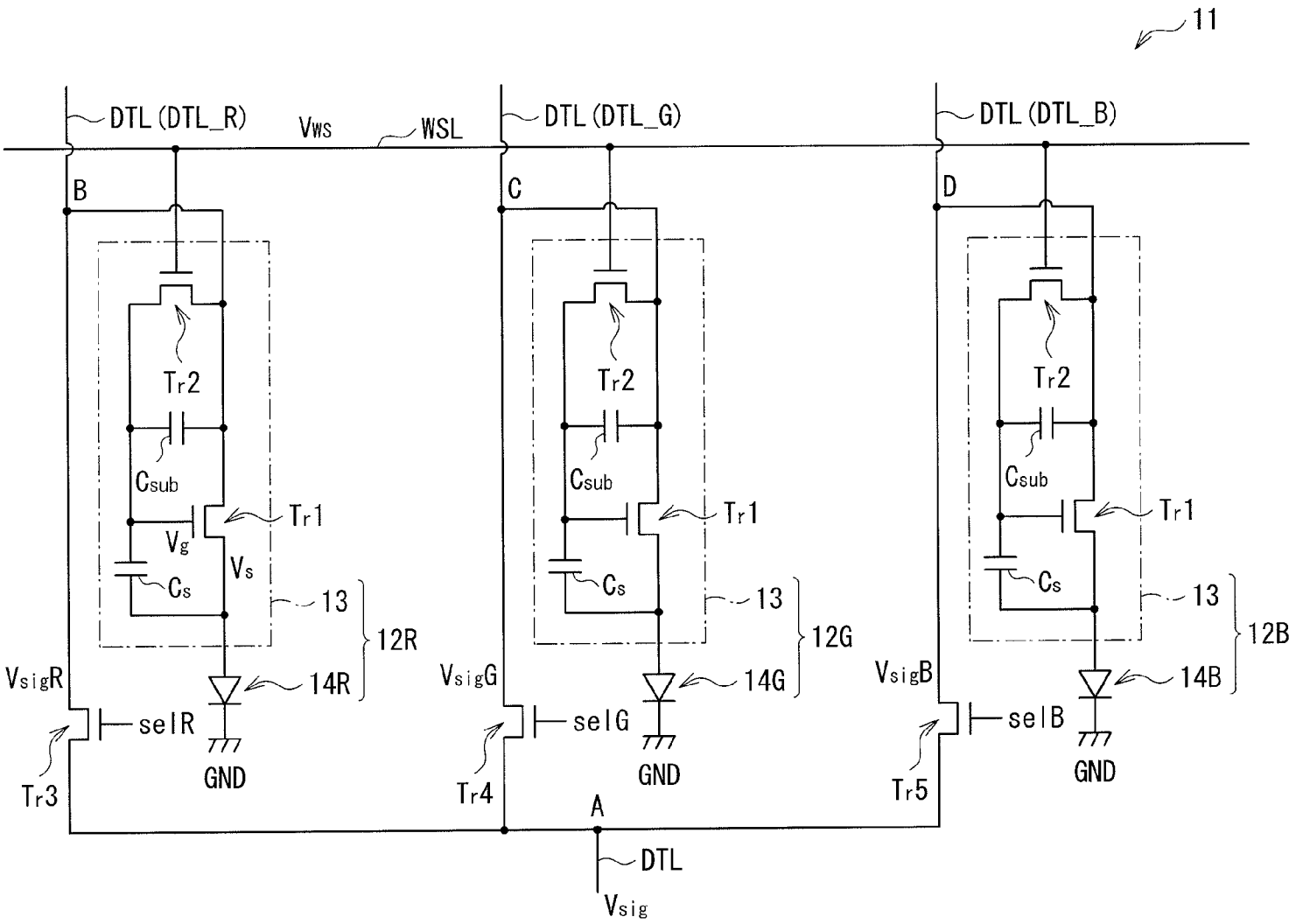
FIG. 2 is a diagram showing an example of a circuit configuration for a pixel illustrated in FIG. 1.

On the display panel 10, a plurality of pixels 11 are arranged in a matrix in a plane in a row direction and a column direction over a whole area of a display region 10A of the display panel 10. The display panel 10 displays an image based on an image signal 20A that is input externally through an active matrix driving of each of the pixels 11. As shown in FIG. 2 for example, each of the pixels 11 includes a red sub-pixel 12R, a green sub-pixel 12G, and a blue sub-pixel 12B. It is to be noted that the sub-pixels 12R, 12G, and 12B are hereinafter collectively referred to as a sub-pixel 12.

The sub-pixel 12R has, for example, a pixel circuit 13 and an organic EL device 14R to emit red light. Similarly, the sub-pixel 12G has, for example, a pixel circuit 13 and an organic EL device 14G to emit green light. Further, the sub-pixel 12B has, for example, a pixel circuit 13 and an organic EL device 14B to emit blue light. It is to be noted that the organic EL devices 14R, 14G, and 14B are hereinafter collectively referred to as an organic EL device 14. The organic EL device 14, which is one of the current drive type light-emitting devices, has a configuration where an anode electrode, an organic layer, and a cathode electrode are laminated in this order for example.

As shown in FIG. 2 for example, the pixel circuit 13 is composed of a driving transistor Tr1, a writing transistor Tr2, a holding capacitor Cs, and a sub-capacitor Csub, employing a circuit configuration of 2 Tr 2 C. The holding capacitor Cs corresponds to a specific but not limitative example of a "first capacitor device". The sub-capacitor Csub corresponds to a specific but not limitative example of a "second capacitor device". The writing transistor Tr2 corresponds to a specific but not limitative example of a "writing circuit". A circuit including the driving transistor Tr1, the holding capacitor Cs, and the sub-capacitor Csub corresponds to a specific but not limitative example of a "driving circuit". The circuit including the driving transistor Tr1, the holding capacitor Cs, and the sub-capacitor Csub generates a current in accordance with an output of the writing transistor Tr2 from a signal line DTL to deliver the resultant current to the organic EL device 14. It is to be noted that the pixel circuit 13 may have a circuit configuration in which a transistor and a capacitor device are further added to the above-described circuit configuration of 2 Tr 2 C.

The writing transistor Tr2 samples a voltage on the signal line DTL to be hereinafter described, while writing such a voltage into a gate of the driving transistor Tr1. The driving transistor Tr1 controls a current flowing through the organic EL device 14 depending on a magnitude of a voltage written by the writing transistor Tr2. The holding capacitor Cs holds a predetermined voltage across a gate and a source of the driving transistor Tr1. The sub-capacitor Csub is for turning on the driving transistor Tr1 utilizing a capacitive coupling obtained by the action of the holding capacitor Cs and the sub-capacitor Csub after a signal writing to be hereinafter described.

The driving transistor Tr1 and the writing transistor Tr2 are formed of, for example, n-channel MOS TFTs (Thin Film Transistors). It is to be noted that a type of the TFTs is not specifically limited, but may be a reverse staggered structure (bottom gate type), or may be a staggered structure (top gate type). Alternatively, the driving transistor Tr1 and the writing transistor Tr2 may be p-channel MOS TFTs.

As shown in FIG. 1 and FIG. 2, the display panel 10 has a plurality of scanning lines WSL extending in a row direction and a plurality of signal lines DTL extending in a column direction. Each of the signal lines DTL is provided correspondingly for each pixel column, being connected with an output end (not shown in the figure) of the signal line driving circuit 23. As shown in FIG. 2, each of the signal lines DTL has a plurality of branched lines DTL_R, DTL_G, and DTL_B that are provided correspondingly for each sub-pixel 12. The branched line DTL_R, which is provided correspondingly to the sub-pixel 12R, is for providing a red-color signal voltage VsigR to the sub-pixel 12R. Similarly, the branched line DTL_G, which is provided correspondingly to the sub-pixel 12G, is for providing a green-color signal voltage VsigG to the sub-pixel 12G. Further, the branched line DTL_B, which is provided correspondingly to the sub-pixel 12B, is for providing a blue-color signal voltage VsigB to the sub-pixel 12B.

The branched line DTL_R is connected with a source or a drain of the writing transistor Tr2 within the sub-pixel 12R. Similarly, the branched line DTL_G is connected with a source or a drain of the writing transistor Tr2 within the sub-pixel 12G. Further, the branched line DTL_B is connected with a source or a drain of the writing transistor Tr2 within the sub-pixel 12B.

In the branched line DTL_R, a switching transistor Tr3 is inserted between a connection point A where the branched line DTL_R, the branched line DTL_G, and the branched line DTL_B are connected with each other and a connection point B where the branched line DTL_R and the writing transistor Tr2 are connected with one another. Similarly, in the branched line DTL_G, a switching transistor Tr4 is inserted between the connection point A and a connection point C where the branched line DTL_G and the writing transistor Tr2 are connected with one another. Further, in the branched line DTL_B, a switching transistor Tr5 is inserted between the connection point A and a connection point D where the branched line DTL_B and the writing transistor Tr2 are connected with one another.

Each of the scanning lines WSL is provided correspondingly for each pixel row. As shown in FIG. 2, each of the scanning lines WSL is connected with a gate of the writing transistor Tr2 within each sub-pixel 12 included in the pixel rows. Each of the scanning lines WSL is also connected with an output end (not shown in the figure) of the scanning line driving circuit 24 to be hereinafter described.

A gate of the writing transistor Tr2 is connected with the scanning line WSL. A source or a drain of the writing transistor Tr2 is connected with the signal line DTL, while a terminal, of a source or a drain of the writing transistor Tr2, unconnected with the signal line DTL is connected with a gate of the driving transistor Tr1. A source or a drain of the driving transistor Tr1 is connected with the signal line DTL, while a terminal, of a source or a drain of the driving transistor Tr1, unconnected with the signal line DTL is connected with an anode of the organic EL device 14. A first end of the holding capacitor Cs is connected with a gate of the driving transistor Tr1, while a second end of the holding capacitor Cs is connected with a terminal, of a source or a drain of the driving transistor Tr1, that is in connection with the anode of the organic EL device 14. A first end of the sub-capacitor Csub is connected with a gate of the driving transistor Tr1, while a second end of the sub-capacitor Csub is connected with a terminal, of a source or a drain of the driving transistor Tr1, that is in connection with the signal line DTL. A cathode of the organic EL device 14 is connected with a ground line GND. The ground line GND is electrically connected with an external circuit (not shown in the figure) that is placed at a reference potential (for example, ground potential).

(Peripheral Circuit 20)

Next, each circuit within the peripheral circuit 20 is described with reference to FIG. 1. The timing generation circuit 21 controls the signal line driving circuit 23 and the scanning line driving circuit 24 to operate in conjunction with each other. For example, the timing generation circuit 21 outputs a control signal 21A to each of these circuits described above depending on a synchronization signal 20B that is input externally (in synchronization with such a signal). Along with the image signal processing circuit 22, the signal line driving circuit 23, the scanning line driving circuit 24, and the like for example, the timing generation circuit 21 is formed on, for example, a control circuit board (not shown in the figure) that is provided separately from the display panel 10.

The image signal processing circuit 22, for example, performs a predetermined correction for the digital image signal 20A that is input externally. Examples of the predetermined correction include gamma correction, overdrive correction, and the like. Further, depending on the synchronization signal 20B that is input externally (in synchronization with such a signal), the image signal processing circuit 22 converts, for example, the corrected image signal 20A as described above into an analog signal, delivering a resulting analog signal voltage 22A to the signal line driving circuit 23 as an output.

The signal line driving circuit 23 outputs the signal voltage 22A, that is input from the image signal processing circuit 22, to each of the signal lines DTL depending on an input of the control signal 21A (in synchronization with this signal), thereby performing a writing into each of the pixels 11 to be selected. It is to be noted that writing refers to an operation in which a predetermined voltage is applied to a gate of the driving transistor Tr1. The signal line driving circuit 23, for example, is capable of outputting a signal voltage Vsig corresponding to the signal voltage 22A, and constant voltages Vss and Vdd independent of the signal voltage 22A. Here, the signal voltage Vsig is a signal voltage including VsigR, VsigG, and VsigB in a time-series manner. The voltage Vss has a voltage value (constant value) lower than that of a threshold voltage of the organic EL device 14. The voltage Vdd has a voltage value (constant value) higher than that of a threshold voltage of the organic EL device 14.

The scanning line driving circuit 24 sequentially applies selection pulses to one or more scanning lines WSL from among a plurality of the scanning lines WSL depending on an input of the control signal 21A (in synchronization with this signal), thereby selecting one or more pixel rows sequentially. The scanning line driving circuit 24, for example, is capable of outputting a voltage Von1 to be applied in turning on the writing transistor Tr2, and a voltage Voff1 to be applied in turning off the writing transistor Tr2.

The peripheral circuit 20 outputs a control signal SelR for the above-described switching transistor Tr3 to a gate of the transistor Tr3. Similarly, the peripheral circuit 20 outputs a control signal SelG for the above-described switching transistor Tr4 to a gate of the transistor Tr4. Also, the peripheral circuit 20 outputs a control signal SelB for the above-described switching transistor Tr5 to a gate of the transistor Tr5. The peripheral circuit 20 outputs a voltage Von2 to be applied in turning on the transistors Tr3, Tr4, and Tr5, as well as a voltage Voff2 to be applied in turning off the transistors Tr3, Tr4, and Tr5.

[Operation]

Figure 3:
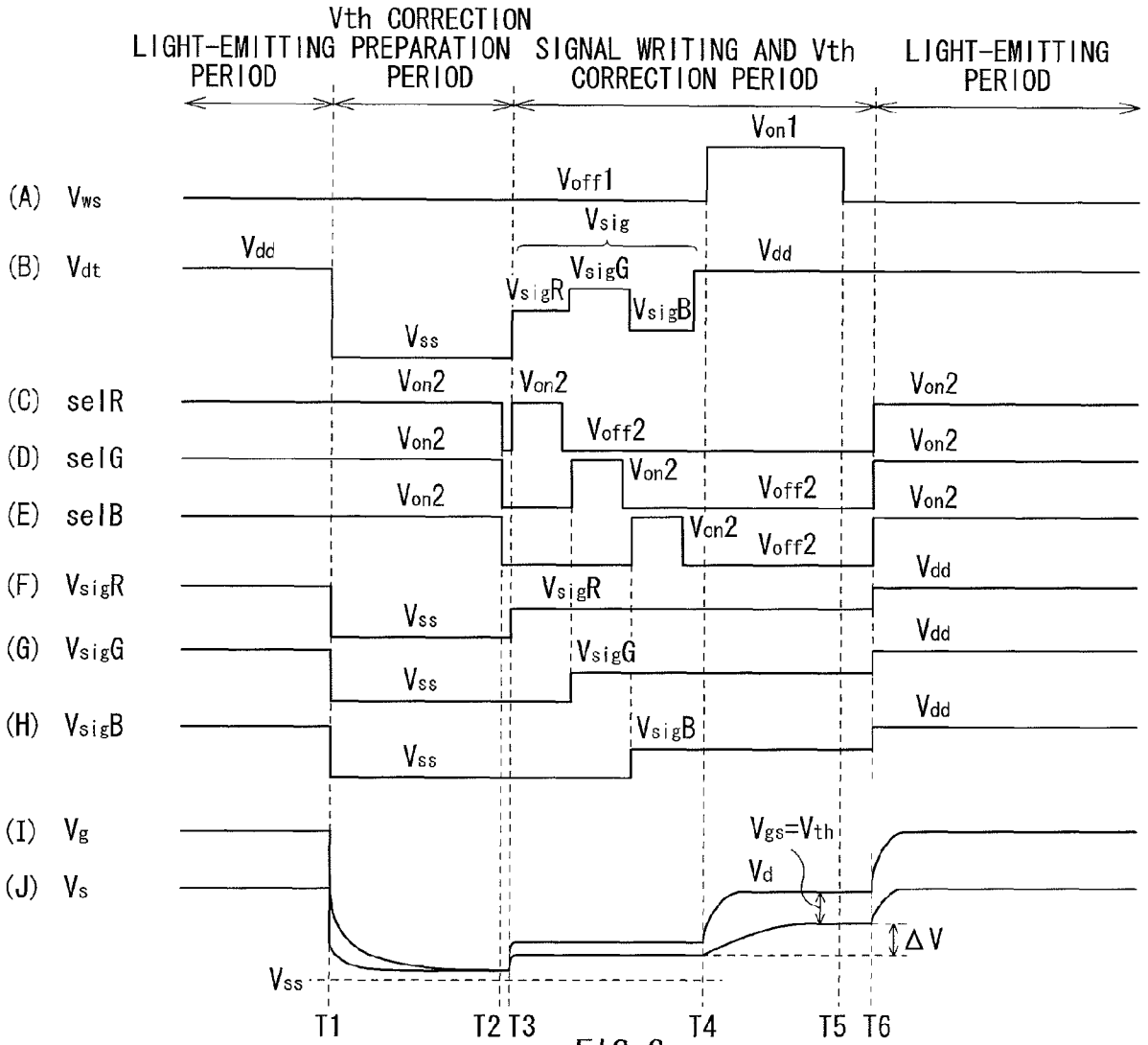
FIG. 3 is a diagram showing an example of variations over time in various voltages to be applied to a display panel, and an example of variations over time in gate voltage and source voltage of a driving transistor.

Next, an operation example of the display unit 1 is described. FIG. 3 shows an example of various waveforms in driving the display unit 1. (A) of FIG. 3 shows a state where the voltages Von1 and Voff1 are applied to the scanning line WSL in a predetermined timing sequence. (B) of FIG. 3 shows a state where the voltages Vsig, Vss, and Vdd are periodically applied to the signal line DTL. Further, (C), (D), and (E) of FIG. 3 show states where the control signal SelR is applied to a gate of the transistor Tr3, the control signal SelG is applied to a gate of the transistor Tr4, and the control signal SelB is applied to a gate of the transistor Tr5, respectively. (F), (G), and (H) of FIG. 3 show states where the voltages VsigR, VsigG, and VsigB on the branched lines DTL_R, DTL_G, and DTL_B are respectively varying every moment over time. (I) and (J) of FIG. 3 show states where a gate voltage Vg and a source voltage Vs of the driving transistor Tr1 that is connected with the branched line DTL_R are respectively varying every moment over time.

[Vth Correction Preparation Period]

First, preparations for Vth correction (threshold correction) are made. In concrete terms, when the voltage Vws on the scanning line WSL is equal to Voff1, and the control signals SelR, SelG, and SelB are equal to Von2, while a voltage on the signal line DTL is equal to Vdd (that is, when the organic EL device 14 is put in a light-emitting state), the signal line driving circuit 23 lowers the voltage Vdt on the signal line DTL from Vdd down to Vss (T1). Thereby, the gate voltage Vg and the source voltage Vs are close to a value of the Vss, resulting in the organic EL device 14 being put in a quenching state. Thereafter, the peripheral circuit 20 lowers the control signals SelR, SelG, and SelB from Von2 down to Voff2 (T2).

[Signal Writing and Vth Correction Period]

When the control signals SelR, SelG, and SelB are equal to Voff2, the signal line driving circuit 23 applies Vsig (VsigR, VsigG, and VsigB) to the signal line DTL (T3). The peripheral circuit 20 raises the control signals SelR, SelG, and SelB up to Von2 sequentially in synchronization with variations over time in the VsigR, VsigG, and VsigB, and thereafter lowers these signals down to Voff2. As a result, the voltage VsigR on the branched line DTL_R is equal to VsigR, and the voltage VsigG on the branched line DTL_G is equal to VsigG, while the voltage VsigB on the branched line DTL_B is equal to VsigB.

Next, while the signal line driving circuit 23 applies the signal voltage Vsig corresponding to the image signal 20A to the signal line DTL, the peripheral circuit 20 makes the driving transistor Tr1 sample the voltage Vdt on the signal line DTL. Thereafter, the peripheral circuit 20 uses a voltage obtained through sampling by the driving transistor Tr1 to correct the gate-source voltage Vgs of the driving transistor Tr1.

In concrete terms, the signal line driving circuit 23 raises the voltage Vdt on the signal line DTL from Vsig up to Vdd, and then the scanning line driving circuit 24 raises the voltage Vws on the scanning line WSL from Voff1 up to Von1 (T4). Thereby, the writing transistor Tr2 turns on, resulting in Vs being written into a gate of the driving transistor Tr1 to turn on the driving transistor Tr1. This allows a current to flow through the driving transistor Tr1, and the holding capacitor Cs and the sub-capacitor Csub are charged to raise the source voltage Vs of the driving transistor Tr1. When the source voltage Vs rises, and the gate-source voltage Vgs of the driving transistor Tr1 reaches Vth (threshold voltage of the driving transistor Tr1), the driving transistor Tr1 turns off. As a result, a current no longer flows through the driving transistor Tr1, which stops rising of the source voltage Vs.

[Light-Emitting Period]

Subsequently, the signal line driving circuit 23 applies the voltage Vdd independent of the image signal 20A to the signal line DTL, and turns on the driving transistor Tr1 utilizing the capacitive coupling obtained by the action of the holding capacitor Cs and the sub-capacitor Csub, while putting the organic EL device 14 in a light-emitting state.

In concrete terms, after the scanning line driving circuit 24 lowers the voltage Vws on the scanning line WSL from Von1 down to Voff1 (T5), the peripheral circuit 20 raises the control signals SelR, SelG, and SelB from Voff2 up to Von2 (T6). Thereby, the voltages VsigR, VsigG, and VsigB on the branched lines DTL_R, DTL_G, and DTL_B are equal to Vdd, and the gate voltage Vg of the driving transistor Tr1 rises due to the capacitive coupling obtained by the action of the holding capacitor Cs and the sub-capacitor Csub. As a result, the gate-source voltage Vgs of the driving transistor Tr1 makes a significant difference, which turns on the driving transistor Tr1. Consequently, a current flows through the driving transistor Tr1, and the organic EL device 14 performs the light emission with desired luminance.

Figure 4:
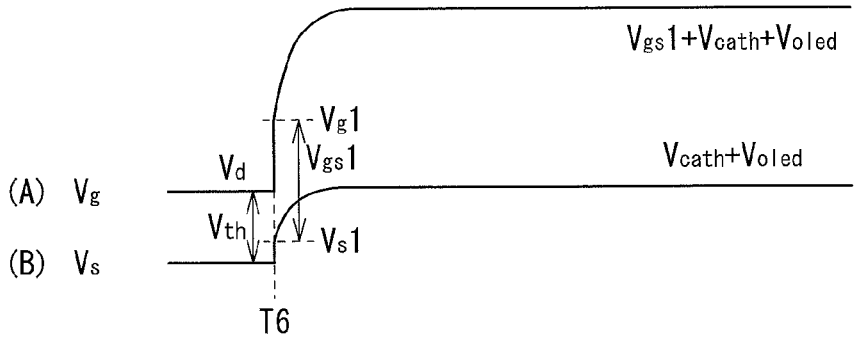
FIG. 4 is a waveform diagram for explaining the capacitive coupling.

Meanwhile, at the moment when the signal voltages VsigR, VsigG, and VsigB on the branched lines DTL_R, DTL_G, and DTL_B become equal to Vdd, the gate voltage Vg and the source voltage Vs of the driving transistor Tr1 rise as well due to the capacitive coupling obtained by the action of the holding capacitor Cs and the sub-capacitor Csub as shown in FIG. 4 in an enlarged view for example. A gate voltage Vg1, a source voltage Vs1, and a gate-source voltage Vgs1 at this time are expressed by the equations represented in FIG. 4. Therefore, it is possible to carry out the Vth correction with this process. Further, the gate-source voltage Vgs1 is a function of Vd, which makes it possible to determine a current value of the driving transistor Tr1 depending on a value of Vd.

It is to be noted that Vd in FIG. 4 is a gate voltage after completion of the Vth correction. Cs is a capacitance of the holding capacitor Cs, and Csub is a capacitance of the sub-capacitor Csub. Voled is a threshold voltage of the organic EL device 14, and Coled is a capacitive component of the organic EL device 14. Vcath is a cathode voltage of the organic EL device 14.

Subsequently, the source voltage Vs becomes a voltage Vcath+Voled depending on a current value of the driving transistor Tr1 and the IV characteristics of the organic EL device 14, and the gate voltage Vg is boot-strapped via the capacitor device Cs to put the organic EL device 14 in a light-emitting state.

Figure 5:
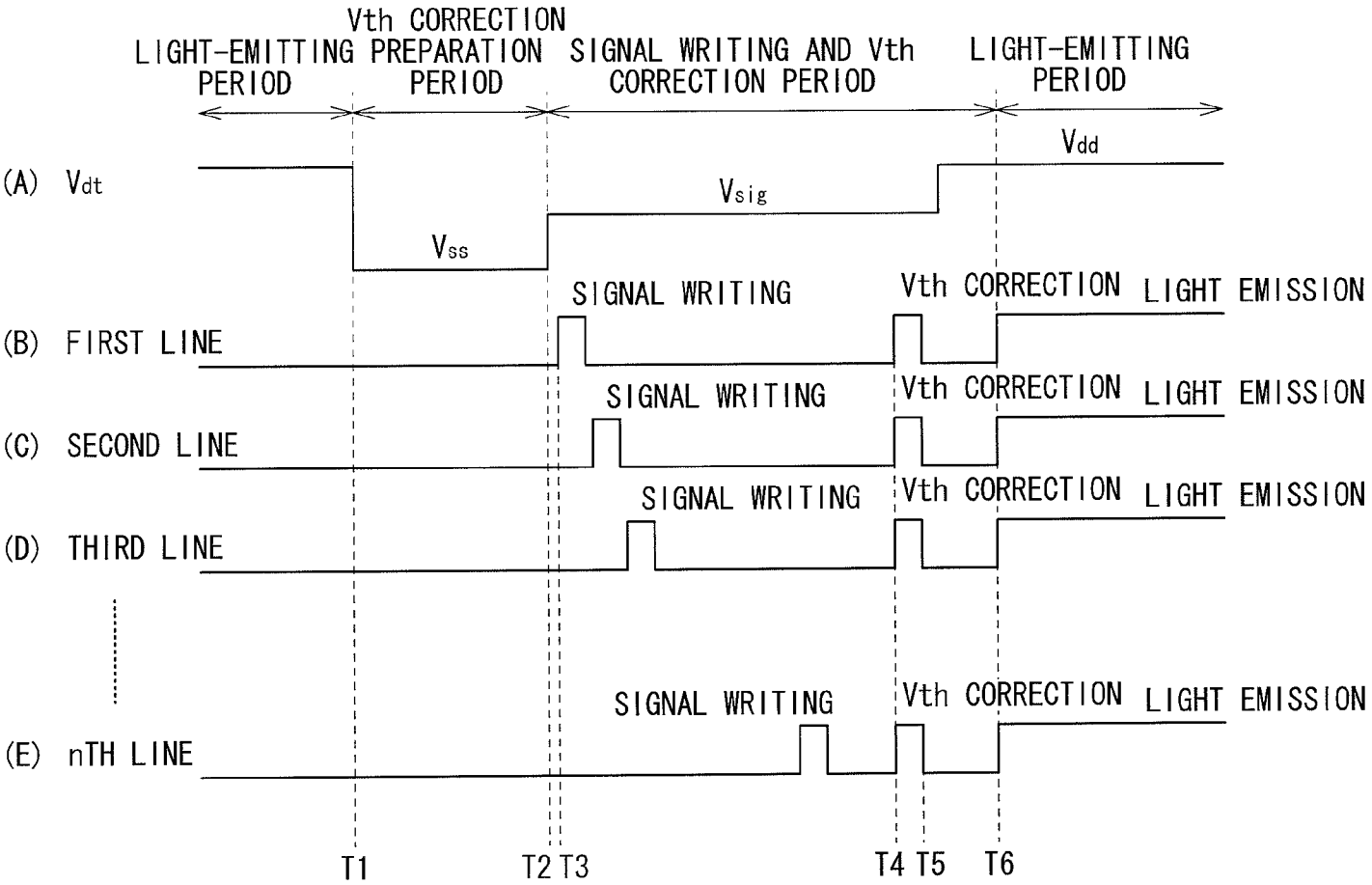
FIG. 5 is a diagram showing an example of scanning for an overall display panel.

It is to be noted that the scanning line driving circuit 24 performs a signal writing sequentially for n-row pixel rows, and then carries out the Vth correction for each pixel row concurrently, further continuing to perform the light emission concurrently as shown in FIG. 5 for example. In such a manner, an image is displayed on the display region 10A.

[Advantageous Effects]

Next, the description is provided on advantageous effects of the display unit 1 according to the present embodiment.

Figure 12:
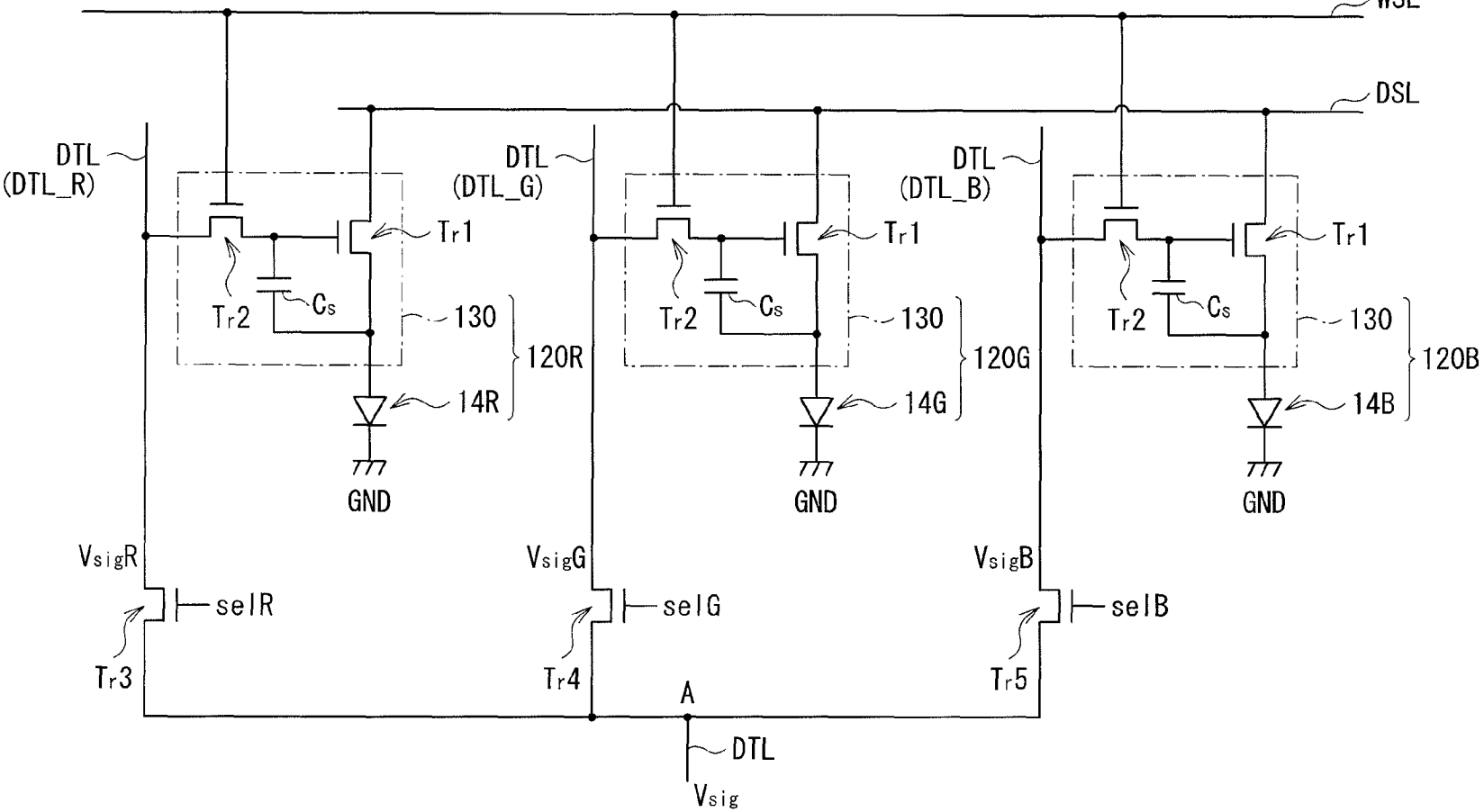
FIG. 12 is a diagram showing an example of a circuit configuration for a typical pixel according to a comparative example.

FIG. 12 shows an example of a circuit configuration for a typical pixel (sub-pixels 120R, 120G, and 120B) according to a comparative example. As shown in FIG. 12, each pixel circuit 130 is connected with the signal line DTL extending in a column direction, as well as the scanning line WSL and the power supply line DSL that extend in a row direction. As a result, it is likely that these wire lines pose an obstacle to the future achievement of higher definition.

In contrast, in the present embodiment, the signal line DTL is connected with the driving transistor Tr1 instead of the power supply line DSL. Consequently, a current that depends on a voltage on the signal line DTL (DTL_R, DTL_G, and DTL_B) is generated from the signal line DTL to flow through (to be delivered to) the organic EL device 14. This allows a current that depends on a voltage on the signal line DTL (DTL_R, DTL_G, and DTL_B) to flow through the organic EL device 14 without providing separately from the signal line DTL a wiring line (power supply line DSL) for supplying a current to the driving transistor Tr1. Therefore, in the present embodiment, it is possible to reduce the number of wiring connections by one as compared with an existing technology.

Further, in the present embodiment, the power supply line DSL is not necessary, and thus a driver for scanning the power supply line DSL is not necessary as well. This allows the manufacturing cost to be reduced due to absence of the cost of the driver for scanning the power supply line DSL. Further, in an example where the driver for scanning the power supply line DSL is provided on a frame of the display panel 10, it is possible to reduce the frame width due to removal of a space occupied by the driver for scanning the power supply line DSL.

(2. APPLICATION EXAMPLES)

Hereinafter, the description is provided on application examples of the display unit 1 described in the above-described embodiment of the present disclosure. The above-described display unit 1 is applicable to display units on electronic system in every field that display externally-input image signals or internally-generated image signals as images or video pictures, such as, but not limited to, a television receiver, a digital camera, a notebook personal computer, a mobile terminal including a cellular phone, and a video camera.

(Module)

Figure 6:
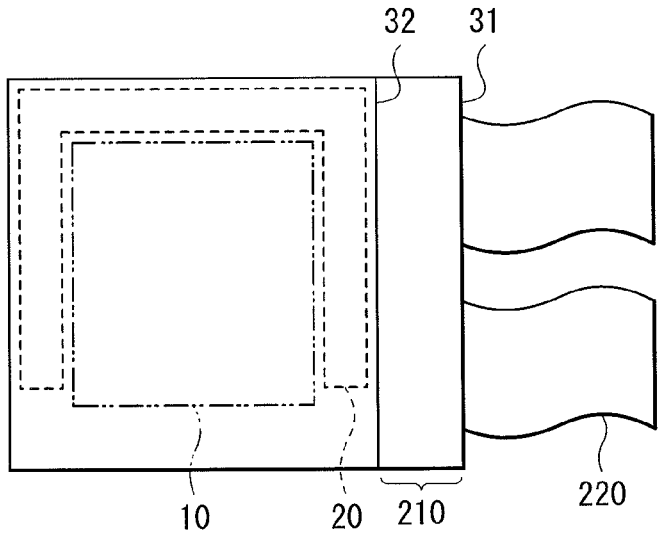
FIG. 6 is a top view showing a schematic structure of a module including the display unit according to the above-described embodiment of the present disclosure.

The above-described display unit 1 may be built into various an electronic system described in application examples 1 to 5 to be hereinafter described as a module shown in FIG. 6 for example. For example, this module has a region 210 exposed from a sealing substrate 32 at one side of a substrate 31, extending wiring of the peripheral circuit 20 to form external connection terminals (not shown in the figure) at this exposed region 210. An FPC (Flexible Printed Circuit) 220 for signal input/output may be provided for the external connection terminals.

(Application Example 1)

Figure 7:
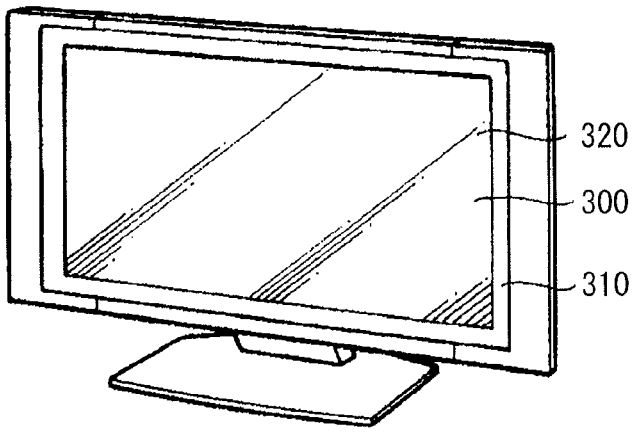
FIG. 7 is a perspective view showing an external appearance of an application example 1 for the display unit according to the above-described embodiment of the present disclosure.

FIG. 7 shows an external view of a television receiver to which the above-described display unit 1 is applicable. This television receiver has, for example, an image display screen section 300 including a front panel 310 and a filter glass 320, and the image display screen section 300 is composed of the above-described display unit 1.

(Application Example 2)

Figure 8A:
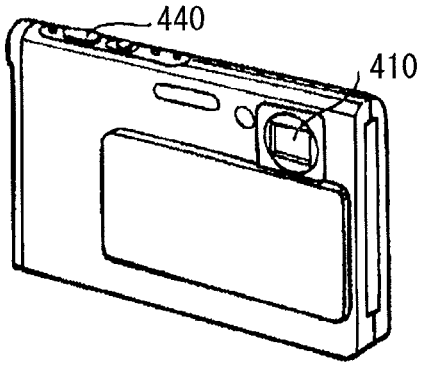
Figure 8B:
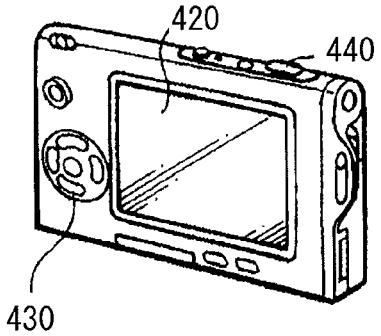
FIG. 8B is a perspective view showing an external appearance that is viewed from the rear side.

FIGS. 8A and 8B each show an external view of a digital camera to which the above-described display unit 1 is applicable. This digital camera has, for example, a light emitting section 410 for flashing, a display section 420, a menu switch 430, and a shutter button 440, and the display section 420 is composed of the above-described display unit 1.

(Application Example 3)

Figure 9:
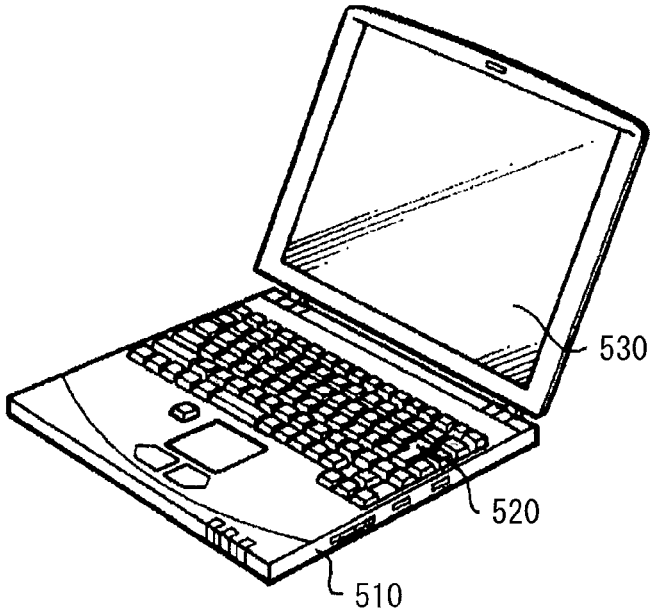
FIG. 9 is a perspective view showing an external appearance of an application example 3.

FIG. 9 shows an external view of a notebook personal computer to which the above-described display unit 1 is applicable. This notebook personal computer has, for example, a main body 510, a keyboard 520 for operation of entering characters and the like, and a display section 530 for image display, and the display section 530 is composed of the above-described display unit 1.

(Application Example 4)

Figure 10:
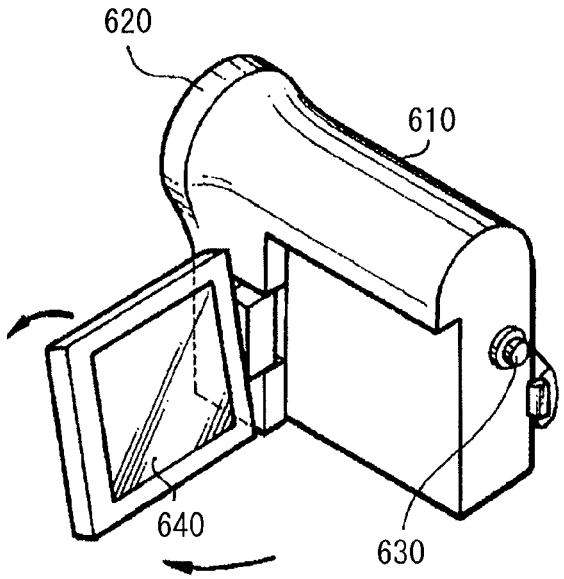
FIG. 10 is a perspective view showing an external appearance of an application example 4.

FIG. 10 shows an external view of a video camera to which the above-described display unit 1 is applicable. This video camera has, for example, a main body section 610, a lens 620 for shooting an image of a subject that is provided at the front lateral side of the main body section 610, a start/stop switch 630 for starting or stopping the shooting of the image of the subject, and a display section 640, and the display section 640 is composed of the above-described display unit 1.

(Application Example 5)

FIGS. 11A to 11G each show an external view of a cellular phone to which the above-described display unit 1 is applicable. For example, this cellular phone, which joins an upper chassis 710 and a lower chassis 720 with a coupling section (hinge section) 730, has a display 740, a sub-display 750, a picture light 760, and a camera 770. The display 740 or the sub-display 750 is composed of the above-described display unit 1.

The present technology is described with reference to the example embodiments, modification examples, and application examples, although the present technology is not limited to the above-described example embodiments of the present disclosure and the like, but different variations are available.

For example, in the above-described embodiment of the present disclosure and the like, a case where the above-described display unit 1 is an active matrix type is described, although a configuration of the pixel circuit 13 for active matrix drive is not limited to that described in the above-described embodiment of the present disclosure and the like, and a capacitor device and a transistor may be added to the pixel circuit 13 as appropriate. In this case, in addition to the signal line driving circuit 23 and the scanning line driving circuit 24 that are described above, other necessary driving circuits may be added according to a change in the pixel circuit 13.

Furthermore, for example, in the above-described embodiment of the present disclosure and the like, the timing generation circuit 21 controls driving of the image signal processing circuit 22, the signal line driving circuit 23, and the scanning line driving circuit 24, although other circuits may carry out such a driving control alternatively. Further, control of the image signal processing circuit 22, the signal line driving circuit 23, and the scanning line driving circuit 24 may be performed in either hardware (circuit) or software (program).

Accordingly, it is possible to achieve at least the following configurations from the above-described example embodiments and the modifications of the disclosure.

(1) A pixel circuit, including:

a writing circuit sampling a voltage of a signal line; and a driving circuit generating from the signal line a current that depends on an output of the writing circuit, and delivering the current to a light-emitting device of a current-drive type.

(2) The pixel circuit according to (1), wherein the driving circuit includes:

a driving transistor having a source, a drain, and a gate, in which one of the source and the drain is connected with the signal line, one of the source and the drain that is unconnected with the signal line is connected with the light-emitting device, and the gate is connected with an output terminal of the writing circuit; and a first capacitor device connected across the gate and the source of the driving transistor.

(3) The pixel circuit according to (1) or (2), wherein the writing circuit includes:

a writing transistor having a source, a drain, and a gate, in which one of the source and the drain is connected with the signal line, one of the source and the drain that is unconnected with the signal line is connected with the gate of the driving transistor, and the gate is connected with the signal line; and a second capacitor device connected across the source and the drain of the writing transistor.

(4) The pixel circuit according to any one of (1) to (3), wherein the light-emitting device is an organic electroluminescence device.

(5) A display panel, including:

a light-emitting device of a current-drive type provided for each pixel; and a pixel circuit provided for each of the pixels and driving the corresponding light-emitting device, each of the pixel circuits including a writing circuit sampling a voltage of a signal line, and a driving circuit generating from the signal line a current that depends on an output of the writing circuit, and delivering the current to the light-emitting device.

(6) A display unit, including:

a display panel including a light-emitting device of a current-drive type and a pixel circuit, the light-emitting device being provided for each pixel, and the pixel circuit being provided for each of the pixels and driving the corresponding light-emitting device; and a peripheral circuit driving the pixel circuits, each of the pixel circuits including a writing circuit sampling a voltage of a signal line, and a driving circuit generating from the signal line a current that depends on an output of the writing circuit, and delivering the current to the light-emitting device.

(7) The display unit according to (6), wherein the driving circuit includes:

a driving transistor having a source, a drain, and a gate, in which one of the source and the drain is connected with the signal line, one of the source and the drain that is unconnected with the signal line is connected with the light-emitting device, and the gate is connected with an output terminal of the writing circuit; and a first capacitor device connected across the gate and the source of the driving transistor.

(8) The display unit according to (6) or (7), wherein the writing circuit includes:

a writing transistor having a source, a drain, and a gate, in which one of the source and the drain is connected with the signal line, one of the source and the drain that is unconnected with the signal line is connected with the gate of the driving transistor, and the gate is connected with the signal line; and a second capacitor device connected across the source and the drain of the writing transistor.

(9) The display unit according to (8), wherein the peripheral circuit:

makes the driving transistor sample the voltage of the signal line while applying to the signal line a signal voltage that corresponds to an image signal;

corrects a gate-source voltage of the driving transistor using a voltage obtained through the sampling by the driving transistor; and applies to the signal line a voltage that is independent of the image signal, to turn on the driving transistor utilizing a capacitive coupling derived from the first capacitor device and the second capacitor device, and thereby to put the light-emitting device in a light-emitting state.

(10) An electronic system, including a display unit including a display panel and a peripheral circuit, the display panel including a light-emitting device of a current-drive type and a pixel circuit, the light-emitting device being provided for each pixel, the pixel circuit being provided for each of the pixels and driving the corresponding light-emitting device, and the peripheral circuit driving the pixel circuits, each of the pixel circuits including a writing circuit sampling a voltage of a signal line, and a driving circuit generating from the signal line a current that depends on an output of the writing circuit, and delivering the current to the light-emitting device.

The present disclosure contains subject matter related to that disclosed in Japanese Priority Patent Application JP 2011-194812 filed in the Japan Patent Office on Sep. 7, 2011, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A pixel circuit, comprising:

a writing circuit sampling a voltage of a signal line; and a driving circuit generating from the signal line a current that depends on an output of the writing circuit, and delivering the current to a light-emitting device of a current-drive type, wherein a peripheral circuit that drives the pixel circuit:

causes a driving transistor of the driving circuit to sample the voltage of the signal line while applying to the signal line a signal voltage that corresponds to an image signal;

modifies a gate-source voltage of the driving transistor using a voltage obtained through the sampling by the driving transistor; and applies to the signal line a voltage that is independent of the image signal, to turn on the driving transistor utilizing a capacitive coupling derived from a first capacitor device connected across a gate and one of a source and a drain of the driving transistor and a second capacitor device connected across a source and a drain of a writing transistor of the writing circuit and connected across the gate and the other of the source and drain of the driving transistor, and thereby to put the light-emitting device in a light-emitting state.

2. The pixel circuit according to claim 1, wherein one of the source and a drain of the driving transistor is connected with the signal line, one of the source and the drain of the driving transistor that is unconnected with the signal line is connected with the light-emitting device, and the gate of the driving transistor is connected with an output terminal of the writing circuit.

3. The pixel circuit according to claim 2, wherein one of the source and the drain of the writing transistor is connected with the signal line, one of the source and the drain of the writing transistor that is unconnected with the signal line is connected with the gate of the driving transistor, and the gate of the writing transistor is connected with the signal line.

4. The pixel circuit according to claim 1, wherein the light-emitting device is an organic electroluminescence device.

5. A display panel, comprising:

a light-emitting device of a current-drive type provided for each pixel; and a pixel circuit provided for each of the pixels and driving the corresponding light-emitting device, each of the pixel circuits including:

a writing circuit sampling a voltage of a signal line, and a driving circuit generating from the signal line a current that depends on an output of the writing circuit, and delivering the current to the light-emitting device, wherein a peripheral circuit that drives the pixel circuit:

causes a driving transistor of the driving circuit to sample the voltage of the signal line while applying to the signal line a signal voltage that corresponds to an image signal;

modifies a gate-source voltage of the driving transistor using a voltage obtained through the sampling by the driving transistor; and applies to the signal line a voltage that is independent of the image signal, to turn on the driving transistor utilizing a capacitive coupling derived from a first capacitor device connected across a gate and one of a source and a drain of the driving transistor and a second capacitor device connected across a source and a drain of a writing transistor of the writing circuit and connected across the gate and the other of the source and drain of the driving transistor, and thereby to put the light-emitting device in a light-emitting state.

6. A display unit, comprising:

a display panel including a light-emitting device of a current-drive type and a pixel circuit, the light-emitting device being provided for each pixel, and the pixel circuit being provided for each of the pixels and driving the corresponding light-emitting device; and a peripheral circuit driving the pixel circuits, each of the pixel circuits including:

a writing circuit sampling a voltage of a signal line, and a driving circuit generating from the signal line a current that depends on an output of the writing circuit, and delivering the current to the light-emitting device, wherein the peripheral circuit:

causes a driving transistor of the driving circuit to sample the voltage of the signal line while applying to the signal line a signal voltage that corresponds to an image signal;

modifies a gate-source voltage of the driving transistor using a voltage obtained through the sampling by the driving transistor; and applies to the signal line a voltage that is independent of the image signal, to turn on the driving transistor utilizing a capacitive coupling derived from a first capacitor device connected across a gate and one of a source and a drain of the driving transistor and a second capacitor device connected across a source and a drain of a writing transistor of the writing circuit and connected across the gate and the other of the source and drain of the driving transistor, and thereby to put the light-emitting device in a light-emitting state.

7. The display unit according to claim 6, wherein one of the source and a drain of the driving transistor is connected with the signal line, one of the source and the drain of the driving transistor that is unconnected with the signal line is connected with the light-emitting device, and the gate of the driving transistor is connected with an output terminal of the writing circuit.

8. The display unit according to claim 7, wherein one of the source and the drain of the writing transistor is connected with the signal line, one of the source and the drain of the writing transistor that is unconnected with the signal line is connected with the gate of the driving transistor, and the gate of the writing transistor is connected with the signal line.

9. An electronic system, comprising a display unit including a display panel and a peripheral circuit, the display panel including a light-emitting device of a current-drive type and a pixel circuit, the light-emitting device being provided for each pixel, the pixel circuit being provided for each of the pixels and driving the corresponding light-emitting device, and the peripheral circuit driving the pixel circuits, each of the pixel circuits including:

a writing circuit sampling a voltage of a signal line, and a driving circuit generating from the signal line a current that depends on an output of the writing circuit, and delivering the current to the light-emitting device, wherein the peripheral circuit:

causes a driving transistor of the driving circuit to sample the voltage of the signal line while applying to the signal line a signal voltage that corresponds to an image signal;

modifies a gate-source voltage of the driving transistor using a voltage obtained through the sampling by the driving transistor; and applies to the signal line a voltage that is independent of the image signal, to turn on the driving transistor utilizing a capacitive coupling derived from a first capacitor device connected across a gate and one of a source and a drain of the driving transistor and a second capacitor device connected across a source and a drain of a writing transistor of the writing circuit and connected across the gate and the other of the source and drain of the driving transistor, and thereby to put the light-emitting device in a light-emitting state.

10. The display panel according to claim 5, wherein one of the source and a drain of the driving transistor is connected with the signal line, one of the source and the drain of the driving transistor that is unconnected with the signal line is connected with the light-emitting device, and the gate of the driving transistor is connected with an output terminal of the writing circuit.

11. The display panel according to claim 10, wherein one of the source and the drain of the writing transistor is connected with the signal line, one of the source and the drain of the writing transistor that is unconnected with the signal line is connected with the gate of the driving transistor, and the gate of the writing transistor is connected with the signal line.

12. The display panel according to claim 5, wherein the light-emitting device is an organic electroluminescence device.

13. The electronic system according to claim 9, wherein one of the source and a drain of the driving transistor is connected with the signal line, one of the source and the drain of the driving transistor that is unconnected with the signal line is connected with the light-emitting device, and the gate of the driving transistor is connected with an output terminal of the writing circuit.

14. The electronic system according to claim 13, wherein one of the source and the drain of the writing transistor is connected with the signal line, one of the source and the drain of the writing transistor that is unconnected with the signal line is connected with the gate of the driving transistor, and the gate of the writing transistor is connected with the signal line.

15. The electronic system according to claim 9, wherein the light-emitting device is an organic electroluminescence device.

16. The pixel circuit according to claim 1, wherein the one of the source and a drain of the driving transistor that is connected to the first capacitor device is connected to the light emitting device.

17. The pixel circuit according to claim 16, wherein the other of the source and drain of the driving transistor that is connected to the second capacitor device is connected to the signal line.

* * * * *